United States Patent [19]

Erlich

[11] 4,326,720

[45] Apr. 27, 1982

[54] CHESS PIECES WITH DETACHABLE MARKERS

[76] Inventor: David Erlich, 406 Audubon Ter., Philadelphia, Pa. 19116

[21] Appl. No.: 203,420

[22] Filed: Nov. 3, 1980

[51] Int. Cl.[3] ..... A63F 3/02

[52] U.S. Cl. ..... 273/239; 273/260; 273/290

[58] Field of Search ..... 273/239, 288, 289, 290, 273/291, 260; 215/211, 236, 296, 298, 305, 354, 355, 363, 1 C, 2

[56] References Cited

U.S. PATENT DOCUMENTS

| | | | |
|---|---|---|---|
| 3,363,902 | 1/1968 | Jones | 273/239 |
| 3,650,534 | 3/1972 | Collett | 273/239 |
| 3,658,338 | 4/1972 | Wheelock | 273/239 |
| 3,947,040 | 3/1976 | Samuels | 273/288 |

FOREIGN PATENT DOCUMENTS

| | | | |
|---|---|---|---|
| 2512026 | 9/1976 | Fed. Rep. of Germany | 273/290 |
| 2338062 | 8/1977 | France | 273/290 |

*Primary Examiner*—Richard C. Pinkham
*Assistant Examiner*—Scott L. Brown
*Attorney, Agent, or Firm*—Max R. Millman

[57] ABSTRACT

Chess pieces each with a detachable marker at the base of the piece to permit playing variations without the necessity of starting from move one of a diagramless game. The marker is removably attached to the piece, preferably by magnetic means, and the board is magnetically attenuated, such as a standard board ferric-metalized at the preferably non-playing surface, to retain the detached marker in the original square yet not interfere with piece movement or reunion of piece and its marker, and make detachment easy despite firm magnetic attachment of piece and marker. The marker includes a portion extending beyond the peripheral edge of the base of the piece so that the marker is visible, but not distractingly so, when attached to the piece to indicate the original position of the piece.

10 Claims, 5 Drawing Figures

CHESS PIECES WITH DETACHABLE MARKERS

This invention relates to the game of chess and, more particularly, to chess pieces with detachable markers.

It is customary for newspapers, magazines and books to set out the various moves of a chess game. However, often the article does not contain a pre-variation diagram and rarely has more than one. To play out a variation without such a diagram may require a person to start from move one to later complete the game, a considerable waste of time and effort.

The primary object of the invention is to provide chess pieces each with a detachable marker to permit playing the variation without the aforementioned waste of time and effort. Thus, a piece can be removed from its marker and moved to different positions on the board as the variation is tried out with the marker remaining in the original square, and after the variation is explored, the piece can be readily reunited with the marker previously left behind, thereby obviating the necessity of remembering the original position or of going back to the beginning if a person desires to continue the game from that point.

Another object of the invention is to provide chess pieces each with a removable marker at the base thereof with a portion of the marker extending beyond the edge of the base of the piece so that the piece with the marker attached is visible, but not distractingly so, in order to determine which pieces had been moved in the course of the variation and which had not.

Another object of the invention is to provide chess pieces each with a detachable marker of such construction that the piece can be readily removed from the marker with one hand, and reunited with one hand, thereby allowing ease of playing out a variation and returning to the pre-variation position.

Another object of the invention is to provide chess pieces each with a marker detachably retained in the base of the piece by magnetic means and aided by an attenuated metallized board so that when the piece is removed from the marker, the latter will be retained in the original square, but thereafter freely movable with the piece attached the magnetic means being of such force as to allow the marker to be readily shed from the piece and reunited thereto yet remain firmly attached to the piece.

Another object of the invention is to provide chess pieces each with a detachable marker in which the magnetic attraction between the markers and the white pieces is opposite to that between the markers and the black pieces to repel the reunion of a piece with the wrong marker therefor. Additionally, the markers contain indicia to signify the piece and its color, such as P for pawn, R for rock, Q for queen, etc.

These and other objects of the invention will become more apparent as the following description proceeds in conjunction with the accompanying drawings, wherein.

Specific reference is now made to the drawings in which similar reference characters are used for corresponding elements throughout.

Indicated generally at 10 is a conventional chess playing board made of cardboard or similar non-metallic insulating material. The playing surface containing the squares may be made of paper, plastic or similar material. For a purpose soon to appear, this invention requires that the board have an attenuated metallic quality which can be obtained by simply applying a metal coating 14 on the side of the board opposite its playing surface, or providing a metal member coextensive with the board as an inner ply or layer.

While the present invention will be described with reference to two illustrative chess pieces, namely, a knight and a pawn, it is to be understood that the invention is applicable to each chess piece, both black and white.

Figure 2:
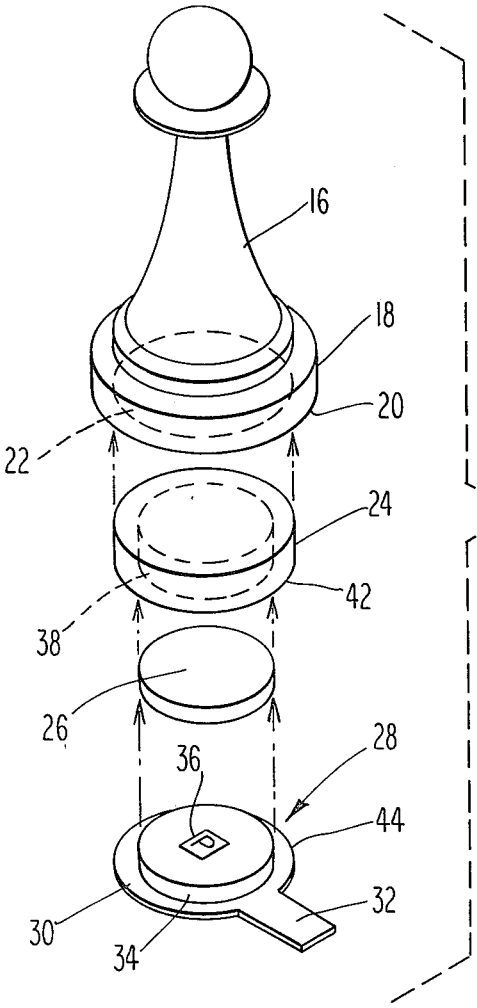
FIG. 2 is a group perspective view of a chess piece showing the assembly of the marker and associated elements in the base of the piece.

Referring first to FIG. 2, the pawn 16, like all other pieces, is made of any suitable non-metallic material such as wood, ivory, plastic, etc. It has a base portion 18 which is generally cylindrical and terminates in a free edge 20. The base includes a hollow portion or recess 22 which is also generally cylindrical and is open at the bottom of the piece.

Secured in the recess 22, preferably by adhesive, is a rubber ring 24 into which a magnet 26, in the shape preferably of a disc, of predetermined strength and polarity position is mounted and there retained by appropriate adhesion.

The detachable marker 28 is a thin non-ferrous member such as, for example, tin having an enlarged preferably circular portion 30 and a narrower tab portion 32 extending therefrom for a predetermined distance. Secured by adhesion on the portion 30 centrally thereof is another magnet 34, preferably in the form of a disc, of predetermined strength and polarity position so that the magnets 26 and 34 will attract. Secured by adhesive on the top surface of the marker magnet 34 is a label 36 with a letter and color thereon corresponding to the chess piece to which the particular marker will be attached such as P for pawn, R for rook, B for bishop, Q for queen, KN for knight, etc.

The piece and marker are assembled or united by moving the marker 28 in position below the base 20 and inserting the marker magnet into the central opening 38 in the rubber ring 24 below the piece magnet 26 whereupon the magnets attract and hold the marker in place with the annular 40 against the lower edge 42 of the rubber ring. In the assembled position the peripheral lower free edge 20 of the piece extends beyond the periphery 44 of the marker. However, the tab 32 extends beyond the peripheral edge of the base of the piece, preferably about $\frac{1}{4}''$, and is visible when the piece and marker are united.

Figure 1:
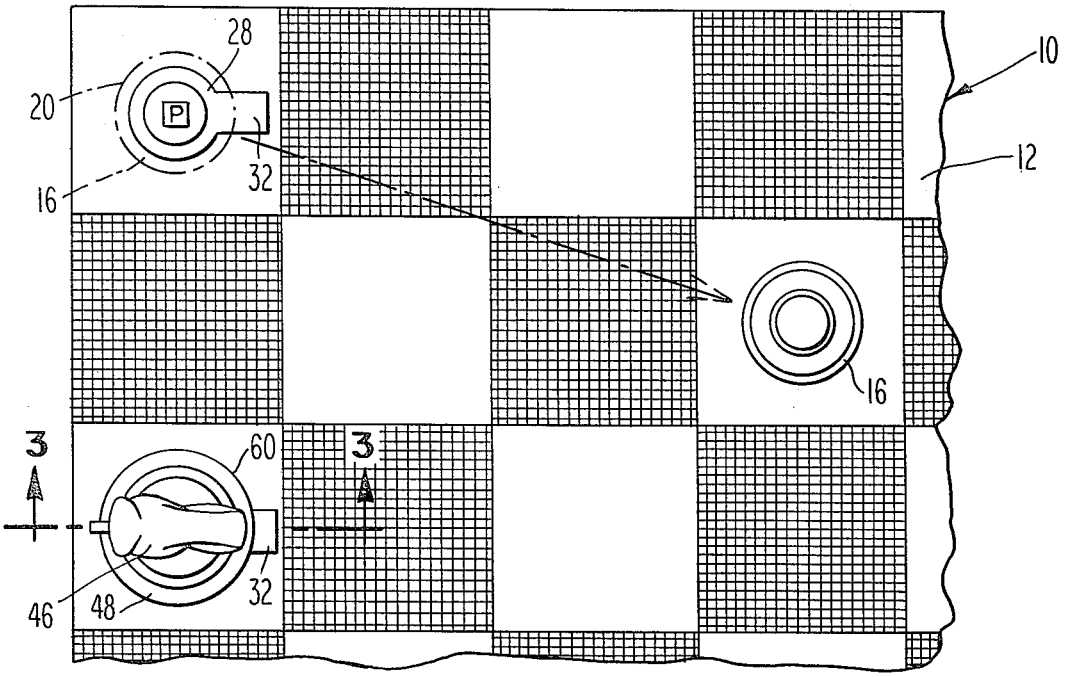
FIG. 1 is a fragmentary plan view of a chess board with a few chess pieces of the present invention thereon and illustrating attached and detached markers.
Figure 3:
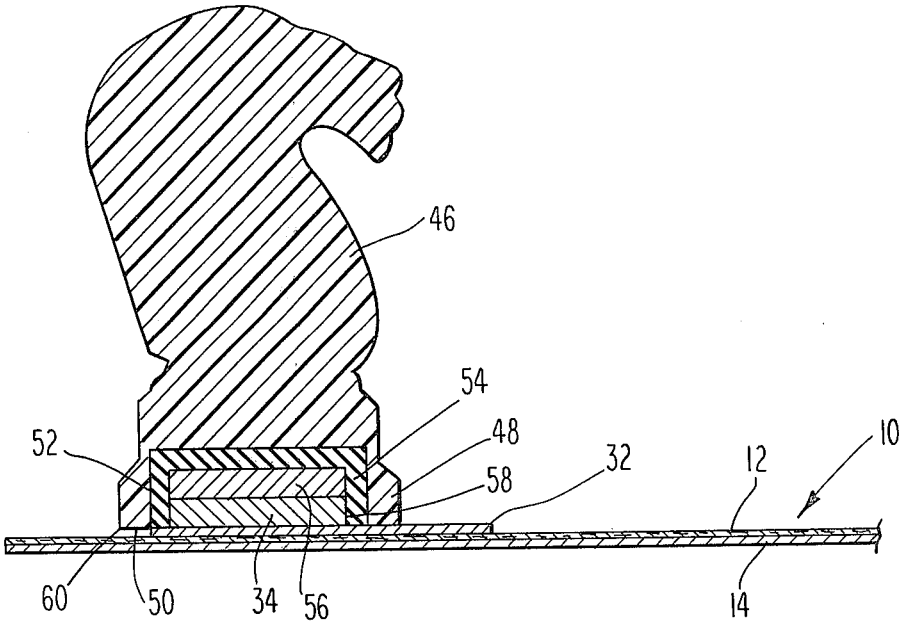
FIG. 3 is an enlarged sectional view taken on the line 3—3 of FIG. 1.

As applied to the knight 46, the cylindrical base 48 thereof has a lower free edge 50, a recess 52 opening through the base, a rubber member 54 in this case in the form of a cylindrical trough secured adhesively in the recess 52 and opening through the bottom thereof and a disc magnet 56 of predetermined strength and polarity position affixed by adhesion within the rubber trough to leave a recess 58 therebelow. The marker 28 is the same as that shown in FIG. 2 and comprises a thin non-ferrous plate having an enlarged portion 30 and a tab 32, there being a disc magnet 34 secured upon the portion 30 of the plate, which magnet is of predetermined strength and polarity position so that the magnets will attract. When the marker magnet 34 is inserted in the recess 58, it contacts the chess piece magnet 56 and the magnet attraction holds the marker in place below the base of the knight. As seen in FIG. 3, the tab 32 extends beyond the peripheral edge 60 of the base 48 and is visible when the marker and piece are united. It will be understood, although not seen in FIGS. 1 and 3, that there will be a label on the magnet 34 for the knight marker with the designating letters KN and its color.

In use, when a player wishes to try out a variation of moves and still know the original squares which contained the pieces before the moves were made, he will take a piece, say the knight, and with one hand rock it to the right of FIG. 3 so that a portion of its peripheral edge 60 will engage the tab 58 and will be removed entirely from the marker while the latter remains in the original square being held there by the attraction of its magnet 34 to the attenuated metallized board 10. After the piece has been moved in various squares to play a variation, it can be reunited with its marker at the original square by holding the piece over the marker whereupon the attraction of the piece and marker magnets literally lifts the marker into place below the piece. The magnets are desirably flat to reduce thickness at the bottom of the chess piece.

The tab 32 extending as it does beyond the periphery of the base of the piece when united therewith informs the player that it has not been moved in the course of the variation.

To prevent the incorrect union of a white piece marker with a black piece and vice versa, the polarity of the magnet set for the white pieces is reverse of the magnet set for the black pieces. For example, if the piece magnet 26, 56 is positioned so that the + pole is up and the − pole is down, the marker magnet 34 will be positioned so that its + pole is up and its − pole is down to effect attraction. Assume this to be the position of the magnets for the white pieces, the position of the magnets for the black pieces will be positioned with the − pole up and the + pole down and the marker for the black piece will be positioned similarly with the − pole up and the + pole down so that they attract. Comparing the white piece magnet with its + pole up and − pole down with the black piece magnet with its − pole up and its + pole down, it will be seen that when the black piece marker is placed below a white piece the − poles will confront each other and therefore repel.

It will be further understood that the strength of the magnets used will be such that the marker will be firmly held on the piece and on the board when the piece is removed but not so strong as to make it difficult to readily remove the piece from the marker, preferably with one hand as described hereinbefore.

Figure 4:
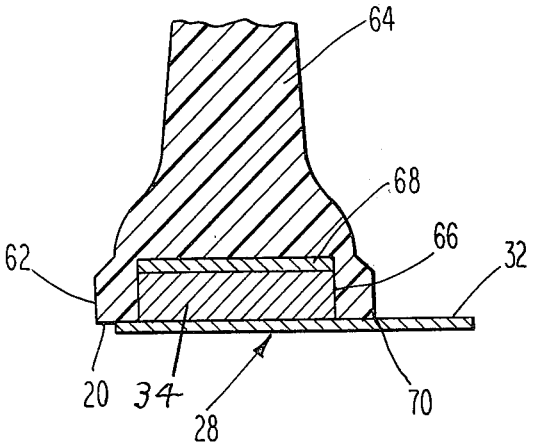
FIG. 4 is a sectional view of the bottom of a piece showing a variant of the attachment of the marker to the base of the piece.

While the use of attracting magnets, one in the chess piece, the other in the marker, is preferred and most versatile, other means for detachably securing the marker to the piece may be used. For example, as shown in FIG. 4, the base 62 of the piece 64, as with the previously described pieces, has a recess 66 opening through the bottom thereof in which is secured by appropriate adhesion a metal disc 68 leaving an open portion of the recess 66 below the metal disc. The marker 28 is the same as that shown in FIG. 2 with its tab 32 and its magnet 34. When the magnet 34 is inserted in the recess portion below the metal disc, the metal disc and magnet will attract holding the marker in place with its tab 32 extending beyond the peripheral edge 70 of the base of the piece. This construction is such that the piece wll pick up the marker when properly held over the marker's magnet. However, it will not provide the function of a white piece repelling a marker for a black piece and vice versa. Such versions with weaker magnetic attraction would not use a ferric-metalized board.

Figure 5:
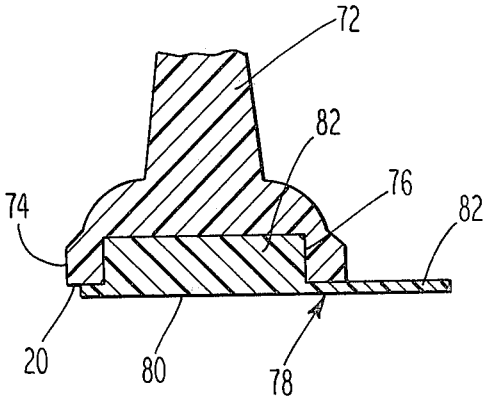
FIG. 5 is a view similar to FIG. 4 of yet another variant of the attachment of the marker to the base of the piece.

In the item shown in FIG. 5, the chess piece 72 has a base 74 with a recess 76 therein opening through the base. The marker 78 is shaped and dimensioned as in FIG. 2 to have a larger central portion 80 and a tab 82. However, the central portion includes an upstanding cylindrical member 82 which is either integral with or fixedly secured upon the central portion. The diameter of the member 82 is such that when it is inserted in the recess 76, the marker will be detachably held in the piece by friction or press fit. In this arrangement the piece will not pick up the marker when held over it nor will it provide the repellent function described hereinbefore.

Thus, it will be seen that chess pieces are provided each with a marker which can be readily united with and removed from the piece to permit the player to move the pieces in a variation without attempting to remember the original position of the pieces since the marker from which the piece has been removed in the course of the variation remains in its original square. The marker includes a tab extending beyond the periphery of the base of the piece so that the marker is visible when united with the piece to inform the player which pieces have been moved in the course of the variation and which have not.

While preferred embodiments have been shown and described, minor variations may be made without departing from the spirit of the invention.

What is claimed is:

1. A chess piece including a base with a peripheral edge, a marker comprised of a plate, a tab extending laterally therefrom and visibly beyond said peripheral edge of said base and a member upstanding from said plate, a recess in said piece opening through said base and receiving said upstanding member and means removably retaining said uptanding member in said recess whereby when said piece is rocked so that said peripheral edge of said base engages said tab as a fulcrum, said piece is removed and can be moved to other squares of a playing board while the marker remains in the original square to indicate the position of origin of said chess piece which can be reunited with said marker.

2. The chess piece of claim 1 wherein said marker plate includes a peripheral edge which does not extend beyond said peripheral edge of said base.

3. The chess piece of claim 1 wherein said means includes a press fit engagement between said upstanding member and said recess.

4. The chess piece of claim 1 wherein said means includes a metal member secured to said piece in said recess in position to leave an open recess portion beneath said metal member, and said upstanding member includes a magnet adapted to enter said recess portion beneath said metal member and attract it to thereby detachably retain said marker on said piece.

5. The chess piece of claim 1 wherein said means includes a first magnet, means retaining said first magnet in said recess in position to leave a recess portion therebeneath, and said upstanding member includes a second magnet adapted to enter said recess beneath said first magnet, said magnets being positioned to attract each other to thereby detachably retain said marker on said piece.

6. The chess piece of claim 5 wherein said means retaining said first magnet in said recess includes an elastomeric washer secured in said recess, said first magnet being retained by said washer.

7. A chess set, each piece including a base, a recess opening through said base, a first magnet, means securing said first magnet in said recess in position to leave an open recess portion therebeneath, a marker including a non-ferrous plate and a tab portion, a second magnet secured upon said marker plate adapted to enter said recess portion beneath said first magnet, said magnets being positioned to attract each other to thereby detachably retain said marker on said piece with said tab extending visibly beyond the periphery of said base of the piece wherein the polarity of the first and second magnets of the white pieces are reverse of the polarity of the first and second magnets of the black pieces so that a white piece will repel a marker of a black piece and vice versa.

8. The chess set of claim 7 and a label on said second magnet identifying the particular chess piece to be detachably secured to said marker.

9. The chess set of claim 7 wherein said means securing said first magnet in said recess is an elastomeric washer secured to the piece in said recess and retaining said first magnet.

10. The chess set of claim 7 and a chess playing board combining metallic and non-metallic materials to provide an attenuated attracting surface for said markers when the piece previously assembled therewith is removed.

* * * * *